US007964091B2

(12) United States Patent
Barendregt et al.

(10) Patent No.: US 7,964,091 B2
(45) Date of Patent: Jun. 21, 2011

(54) CRACKING FURNACE

(75) Inventors: Simon Barendregt, Rhoon (NL); Matthew Bowers Pitcher, Den Haag (NL); Jan den Uijl, Nieuwerkerk a/d IJssel (NL)

(73) Assignee: Technip France (FR)

( * ) Notice: Subject to any disclaimer, the term of this patent is extended or adjusted under 35 U.S.C. 154(b) by 852 days.

(21) Appl. No.: 10/588,423

(22) PCT Filed: Feb. 4, 2005

(86) PCT No.: PCT/NL2005/000078

§ 371 (c)(1),
(2), (4) Date: Sep. 28, 2007

(87) PCT Pub. No.: WO2005/075607

PCT Pub. Date: Aug. 18, 2005

(65) Prior Publication Data

US 2008/0142411 A1 Jun. 19, 2008

(30) Foreign Application Priority Data

Feb. 5, 2004 (EP) ..... 04075364

(51) Int. Cl.
*C10G 9/20* (2006.01)
*C10G 9/18* (2006.01)
*B01D 1/00* (2006.01)

(52) U.S. Cl. ..... 208/132; 208/130; 196/110; 196/116; 422/197; 422/204

(58) Field of Classification Search ..... 196/110, 196/116; 422/197, 204; 208/130, 132; 165/81, 165/163; 122/235, 91
See application file for complete search history.

(56) References Cited

U.S. PATENT DOCUMENTS

| | | | | |
|---|---|---|---|---|
| 2,089,292 | A | 8/1937 | Ocon | |
| 2,182,586 | A | 12/1939 | Heid | |
| 2,324,553 | A | 7/1943 | Barnes | |
| 3,641,190 | A | 2/1972 | Kivlen et al. | |
| 3,820,955 | A * | 6/1974 | Woebcke | 422/197 |
| 4,097,544 | A * | 6/1978 | Hengstebeck | 585/634 |
| 4,499,055 | A * | 2/1985 | DiNicolantonio et al. | 422/197 |
| 4,529,381 | A * | 7/1985 | Michelson | 432/194 |
| 4,792,436 | A * | 12/1988 | Tsai | 422/111 |
| 4,817,672 | A * | 4/1989 | Broodman | 138/113 |
| 4,819,586 | A * | 4/1989 | Kreuter | 122/235.14 |

(Continued)

FOREIGN PATENT DOCUMENTS

WO WO 97/28232 8/1997

(Continued)

OTHER PUBLICATIONS

International search report PCT/NL2005/000078 dated Apr. 27, 2005 (European Patent Office).

*Primary Examiner* — N. Bhat
(74) *Attorney, Agent, or Firm* — Ostrolenk Faber LLP

(57) ABSTRACT

A cracking furnace having a firebox provided with cracking coils is described. The cracking coils have at least one inlet, at least one inlet section, at least one outlet and at least one outlet section, and burners, and the parts of the coils are shielded. A process for cracking hydrocarbon feeds, and making use of a furnace with the thermal shielding are also described.

22 Claims, 14 Drawing Sheets

U.S. PATENT DOCUMENTS 4,906,442 A * 3/1990 Johnson et al. ..... 422/188
4,997,525 A * 3/1991 Martens et al. ..... 196/110
5,124,003 A * 6/1992 Martens et al. ..... 196/110
5,147,511 A * 9/1992 Woebcke ..... 196/110
5,151,158 A * 9/1992 Bowen et al. ..... 196/110
5,181,990 A * 1/1993 Arisaki et al. ..... 196/110
5,409,675 A * 4/1995 Narayanan ..... 422/197
5,817,226 A * 10/1998 Lenglet ..... 208/130
6,488,839 B1 12/2002 Lenglet et al.
6,528,027 B1 * 3/2003 Brewer et al. ..... 422/200
7,048,041 B2 * 5/2006 Brewer et al. ..... 165/162
7,172,412 B2 * 2/2007 Platvoet et al. ..... 431/9
7,482,502 B2 * 1/2009 Brown et al. ..... 585/652
7,503,289 B2 * 3/2009 Spoto et al. ..... 122/91

FOREIGN PATENT DOCUMENTS

WO WO 01/55280 A 8/2001

* cited by examiner

3D View

Side View

Front View

CRACKING FURNACE

CROSS REFERENCE TO RELATED APPLICATION

The present application is a 35 U.S.C. §§371 national phase conversion of PCT/NL2005/000078, filed 4 Feb. 2005, which claims priority of European Patent Application No. 04075364.2, filed 5 Feb. 2004. The PCT International Application was published in the English language.

BACKGROUND OF THE INVENTION

The invention relates to a furnace for (thermally) cracking a hydrocarbon feed in the vapour phase in the presence of steam. The invention further relates to a method for (thermally) cracking a hydrocarbon feed in the vapour phase in the presence of a diluent gas, in particular steam.

Cracking furnaces are the heart of an ethylene plant. In these furnaces, feeds containing one or more hydrocarbon types are converted into a cracked product gas by cracking of hydrocarbons. Typical examples of hydrocarbon feeds are ethane, propane, butanes, naphtha's, kerosenes and atmospheric and vacuum gasoils.

Processes for converting hydrocarbons at higher temperature have been known for many decades. U.S. Pat. No. 2,182,586, published in 1939, describes a reactor and process for the pyrolytic conversion of a fluid hydrocarbon oil. Use is made of a horizontally arranged single reactor pipe (the publication refers to "tubes", but these are connected in a serial flow connection and thus form in fact a single tube), which results in relatively long residence times which are common in the process of thermal cracking of liquid hydrocarbon oils to improve motor fuel quality such as visbreaking. The use of the described heater for a process like steam cracking or for the cracking of a vaporous feed is not mentioned. Rather, excessive cracking and excessive gas formation are avoided.

U.S. Pat. No. 2,324,553, published in 1943, shows another heater for the pyrolytical conversion of hydrocarbons, wherein the reactor pipe is formed of serially connected "tubes", which are horizontally positioned in the heater. In the described process, oil is passed through the tube to a temperature below an active cracking temperature.

WO 97/28232 describes a cracking furnace for thermally cracking a liquid hydrocarbon feed in a spiral pipe. The furnace is said to have a reduced sensitivity for coke formation and an increased liquid residence time. It is not disclosed to use the installation for steam cracking.

Steam cracking is a specific form of thermal cracking of hydrocarbons in the presence of steam with specific process kinetics and other process characteristics. Herein, the hydrocarbon feed is thermally cracked in the vapour phase in the presence of steam. The cracking is carried out at much higher severity than applied in the moderate cracking of liquid hydrocarbon oils to improve fluid quality. Steam cracking furnaces comprise at least one firebox (also known as a radiant section), which comprises a number of burners for heating the interior. A number of reactor tubes (known as cracking tubes or cracking coils) through which the feed can pass, are disposed through the firebox. The vapour feed in the tubes is heated to such a high temperature that rapid decomposition of molecules occurs, which yields desired light olefins such as ethylene and propylene. The mixture of hydrocarbon feed and steam typically enters the reactor tubes as a vapour at about 600° C. In the tubes, the mixture is usually heated to about 850° C. by the heat released by firing fuel in the burners. The hydrocarbons react in the heated tubes and are converted into a gaseous product, rich in primary olefins such as ethylene and propylene.

In cracking furnaces, the reactor tubes may be arranged vertically in one or more passes. In the art, the term cracking coil is also used. One or more of the cracking coils, which may be identical or not identical, may be present to form the total radiant reactor section of a firebox. Conventionally, ethylene cracking tubes are arranged in the firebox in one lane wherein the lane is heated from both sides by burners.

Such a lane may be in a so-called in-line arrangement whereby all the reactor tubes are arranged in essentially the same vertical plane. Alternatively, the tubes in such a lane may be in a so-called staggered arrangement whereby the tubes are arranged in two essential vertical parallel planes whereby the tubes are arranged in a triangular pitch towards each other. Such a triangular can be with equal sides (i.e. equilateral triangular pitch) or with unequal sides which is called an extended pitch.

Examples of such a extended pitch configuration are isosceles triangular pitch, right angled triangular pitch and any other non-equilateral triangular pitch. An example of such a furnace with an extended pitch is GK6™ (see FIG. 1) featuring a isosceles non-equilateral triangular pitch in a dual lane coil arrangement. In the GK6 furnace, the set of two lanes is heated from both sides by burners 5 located in the bottom and/or sidewall. The inlet sections (extending from inlets 4) and outlet sections (extending from outlets 3) are heated essentially equally by the burners 5.

It has been found that this leads to less-optimal cracking conditions. It is thought that this is due to a not so advantageous heat distribution. The cracking process is an endothermic process and requires the input of heat into the feed. For the performance (selectivity) of the cracking process it is desirable to maximise the heat input to the inlet section of the cracking coil (tube). The inventors therefore sought a way to alter the input of heat into the cracking tubes.

In addition, it has been found that the use of a known furnace for (thermally) cracking a hydrocarbon vapour in the presence of steam, thereby forming ethylene, propylene and/or one or more other alkenes (also called olefins), leads to less favourable conditions for mechanical stability of the cracking coil assembly.

The inventors realised that due to the fact that inlet sections at one side of the staggered lane have different temperature conditions and heat distribution conditions than the outlet sections at the other side of the staggered lane, different thermal stress and thermal creep conditions exists between the inlet sections and the outlet sections. Creep is the irreversible expansion which occurs when heating a metal. Creep is the result of thermal stresses inside the metal due to heating. Thermal stress (caused by thermal expansion) is the reversible phenomenon when heating any material. Both phenomena have to be taken care of in the design of the coil and cause the above mentioned restrictions in the cracking coil mechanical layout.

Therefore such a staggered coil arrangement is usually considered less suitable in steam cracking furnaces to convert light hydrocarbon gases such as ethane. In the steam cracking of ethane, due to stiff nature of carbon deposit at the inside of the coil, too much unbalance in thermal stresses and thermal creep may cause tube bending or even coil rupture. However, even with an in-line arrangement conventionally applied in the art of ethane cracking, such an arrangement requires a complicated coil support system at the inlet, outlet and bottom part necessary to compensate for the thermal stresses and thermal creep. This is also the case in cracking heavier vapour hydrocarbons where a sufficient extended staggered arrangement with a properly designed coil support system with variable adjustment parameters could be adequate. However continuous operator attention is required to adjust support system settings in case of different operating conditions and during the operating life of the furnace as coil dimensions and strength change as a consequence of creep over time.

It has been found that the input of heat, in a method for (steam) cracking a hydrocarbon can be altered by designing inlet- and outlet sections of the cracking coils in a specific way.

Further, it has been found that the thermal stability of the coils can be improved by designing the cracking furnace, in particular the inlet- and outlet sections of the cracking coils in the fire box of the furnace in a specific way.

SUMMARY OF THE INVENTION

Accordingly, the present invention relates to a method for cracking a hydrocarbon feed, comprising passing the feed, comprising a hydrocarbon and a diluent gas, in particular steam, through at least one cracking coil (in the priority application also referred to as cracking tube) in a firebox under cracking conditions, wherein the outlet section of each said coil is more thermally shielded than the inlet section of said coil.

In the method of steam cracking according to the invention, the feed comprising steam and hydrocarbon is usually fed to the coil as a vapour or gas. Unless specified otherwise, the term "vapour" respectively "vaporous" as used herein includes "gas" respectively "gaseous".

In addition, the invention relates to a novel cracking furnace, suitable for cracking hydrocarbons, in particular in a method according to the invention.

Accordingly, the present invention further relates to a cracking furnace (for steam cracking a hydrocarbon feed), comprising at least one firebox provided with a plurality of cracking coils, said coils comprising at least one inlet section and at least one outlet section, said firebox comprising at least one lane of outlet sections of the cracking coils, at least two lanes of inlet sections of the cracking coils and at least two lanes of burners, wherein the at least one lane of outlet sections is located between the at least two lanes of inlet sections and the lanes of inlet sections are located in between the at least two lanes of burners.

The lanes of burners are usually essentially parallel to each other. The burners are usually mounted in the bottom and/or sidewalls and/or roof of the firebox.

DESCRIPTION OF A PREFERRED EMBODIMENT

Figure 5A:
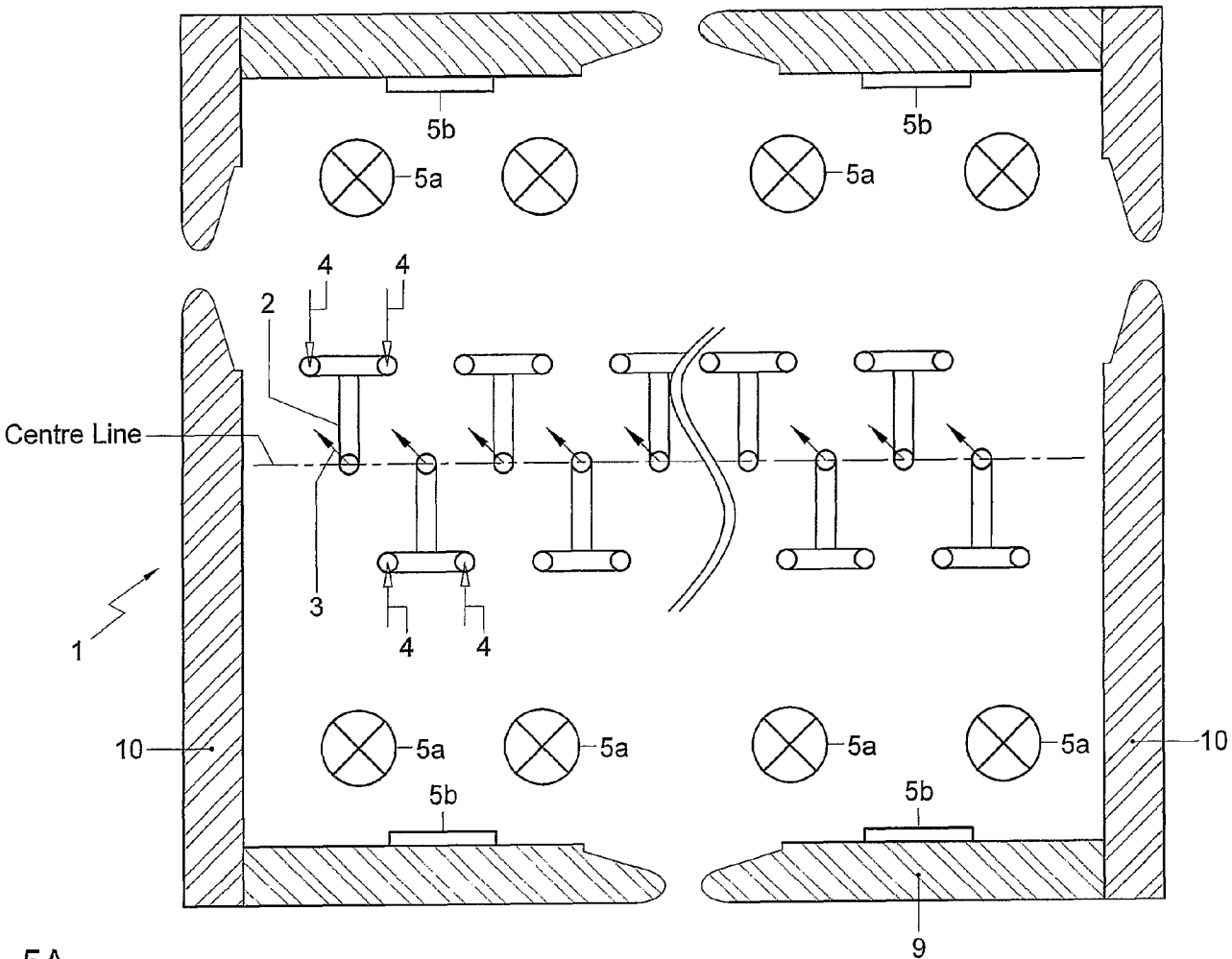
FIG. 5A shows the top view of a furnace according to the invention, wherein the coils have a two-pass split coil lay out.
Figure 5B:
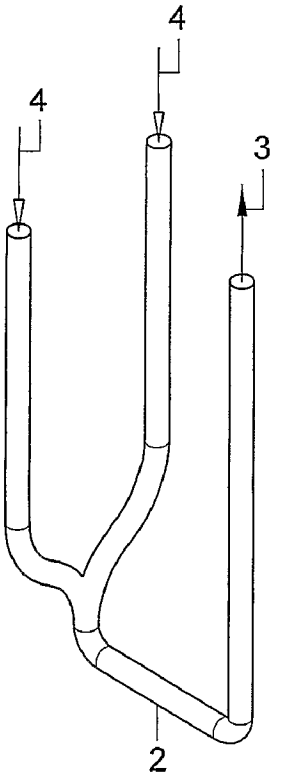
FIG. 5B shows a 3-D view of a single coil as in the furnace of FIG. 5A.
Figure 5C:
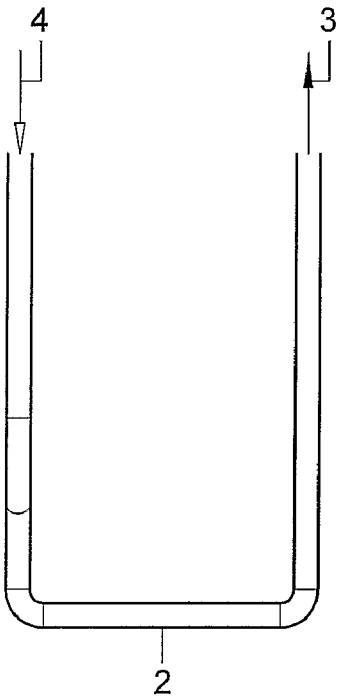
FIG. 5C shows a side view of the single coil of FIG. 5B.
Figure 5D:
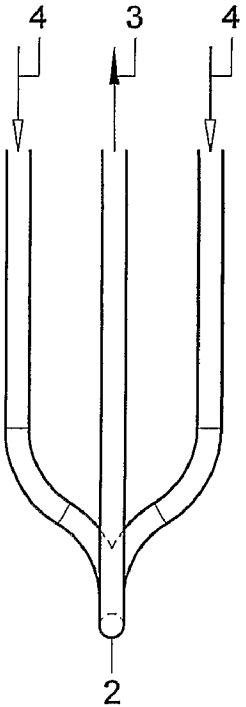
FIG. 5D shows a front view of the coil of FIG. 5B.

Suitable cracking coils (also referred to as cracking tubes), are generally known. The coils may be formed of one or more cylindrical tubular conduits, preferably with a circular or oval cross-section. The conduits may be connected by connecting devices such as but not limited to connecting tubes and bends to provide a number of passes, e.g. as shown in FIG. 3B and in FIG. 6B. A cracking coil may be formed of a plurality of tubular conduits joined together, for example having an "m-like shape" or "w-like shape" wherein the outer legs represent inlet sections which mount in a single outlet section, represented by the central leg of the w/m. Particularly suitable examples wherein tubes are joined together to form a cracking coil are shown in FIG. 5D and in FIG. 8 (w-shaped). In the art, such cracking coils are commonly known as "Split-Coil" designs.

The coils generally each have at least one inlet and at least one outlet The inlet of the coil is a conduit via which, during use, the feed enters the cracking coil and usually thereby the firebox; the outlet is the conduit via which, during use, the product leaves the cracking coil, and thereby usually the firebox. The outlet may be connected with other processing equipment such as but not limited to heat exchangers and/or quenchers.

The inlet section of a coil is the first part (in the longitudinal direction) of the coil that is inside the firebox, starting from the inlet of the coil into the firebox. It may extend up to the beginning of the outlet section. In particular, it is the part that is less thermally shielded than the outlet section. In a preferred embodiment, the inlet section is the part of the coil that thermally shields the outlet section of the coil, when operating the furnace.

The outlet section of a coil is the last part (in the longitudinal direction) of the coil that is inside the firebox, ending at the outlet of the coil going out of the firebox. In particular it is the part that is more thermally shielded than the inlet section. It may extend up to the end of the inlet section or to an intermediate section connecting inlet section and outlet section (such as return bends, as will be discussed below).

Usually, a plurality of the cracking tubes are connected to each other to form a parallel flow path for the feed. Thus, in contrast to a design wherein the "tubes" are connected in a serial manner and wherein the feed enters a first "tube", is partially converted and thereafter enters a subsequent "tube", the present design allows the composition of the stream at the inlet of each tube to be essentially the same for each tube. This allows short residence time and thereby high through put. If desired, during use, a plurality of the cracking tubes may thus be fed from a single container or conduit that is split into a number of feed streams, each fed to the inlet of a cracking tube and/or the product stream leaving the plurality of tubes via the outlet may be combined again into a single conduit or container.

The term that an entity (such as a coil section) is "thermally shielded" is defined herein as heat, being hindered to be transferred into the entity. This term is in particular used herein to indicate the extent to which heat generated by the burners during operation of the cracking furnace is hindered to be transferred into the shielded entity. With respect to the outlet sections of the coils being more thermally shielded than the inlet sections of the coils, this means in particular that the heat transfer into the cracking coils at the outlet section of the coil is shifted in favour of the heat transfer into the cracking coils at the inlet section of the coil, during operation of the burners compared to a coil configuration whereby such shielding is not or less occurring.

The term essentially vertically is used herein to indicate that an entity (such as a coil/tube or part thereof, a lane, a wall, etc) at least during use is at an angle of more than 45° with a horizontal surface (usually the floor of the firebox), in particular at an angle of more than 80°, preferably at an angle of about 90°.

The term essentially horizontal is used herein to indicate that an entity (such as a coil/tube or part thereof, a lane, a wall, etc.) at least during use, is at an angle of less than 45° with a horizontal surface (usually the floor of the firebox), in particular at an angle of less than 10°, preferably at an angle of about 0°.

The term essentially parallel (used in the geometrical sense) is used herein to indicate that an entity (such as a tube or part thereof, a lane, a wall, etc.) at least during use, is at an angle of less than 45° with another entity to which the entity is said to be essentially parallel, in particular at an angle of less than 10°, preferably at an angle of about 0°.

The term "about" and the like, as used herein, is in particular defined as including a deviation of up to 10%, more in particular up to 5%.

A process according to the invention respectively a furnace of the invention may offer several advantages.

In particular the outlet section of a coil is thermally shielded from the burners by the inlet section, which is beneficial, for reasons discussed in detail below. Due to the increase in thermal duty to the inlet section, which occurs at the expense of thermal duty to the outlet section of a cracking coil, less residence time is needed to reach a certain feed conversion. This will allow the furnace designer to apply a shorter residence coil design when construing a furnace applying the invention. Due to the shorter residence time, the reaction kinetics favour the formation of the desired products such as ethylene at the expense of the formation of unwanted byproducts. Consequently, less amounts of feed is required to produce a given quantity of the desired product, for instance ethylene.

The shielding may contribute to a reduction in cokes formation at the outlet section of the coil which is a limiting factor in furnace on-stream time.

As a consequence, the furnace can operate longer before it is required to stop the cracking operation of the furnace to enable decoking of the furnace. Alternatively, instead of extending furnace operation, the furnace capacity can be increased.

The inventors have realised that the shielding of the outlet sections by the inlet sections, optionally in combination with other factors (as discussed below), contribute to an improved mechanical stability of the coils, also at elevated temperature, in particular when used under conditions common for steam cracking, such as heating of the coils to a temperature of about 850° C. or more (i.e. temperature at outer surface of the coil wall). The temperature may even rise to about 1100° C. or more, in particular when the furnace is nearing the end-of run conditions and a furnace decoke operation becomes necessary. Such a high temperature of the coils is usually relatively close to the melting point of the material the coils are made of (such as high alloy Nickel_Chromium material). In particular under such high temperature conditions, creep caused by thermal stresses becomes an important factor, complicating the design of a robust coil assembly in a conventional cracking furnace. Metal temperature changes as small as 10° C. already are important design parameters at such high elevated temperatures.

Without being bound by theory, it is contemplated that since the inlet sections are close to the burners, the coil wall temperature at the inlet section is increased. With a higher temperature of the inlet section, the creep as well as thermal expansion of the inlet section increases and will be closer to the creep and the thermal expansion of the outlet section of the coils (wherein the wall temperature is generally higher, than in the inlet section). Due to difference in creep and/or in thermal expansion between the inlet sections and the outlet sections the deformation of the radiant coil during operation is reduced.

Preferably, said lanes of inlet sections of the coils, outlet sections of the coils and burners in the firebox are positioned geometrically essentially parallel to each other.

Preferably, the outlet sections and the inlet sections of the tubes are positioned geometrically essentially parallel to each other and positioned essentially vertically, at least during use.

It will be understood that in particular (part of the) intermediate sections (such as returning bends 8, see FIG. 8C) of the coils connecting inlet section(s) and outlet section(s) may be positioned essentially non-vertically.

Preferably, the cracking coils are arranged in a staggered configuration, in particular a non-extended or extended staggered configuration.

The lanes of burners are usually essentially parallel to each other. The burners are usually mounted in the bottom and/or sidewalls and/or roof of the firebox. Thus, all burners may be positioned in either the bottom, the sidewalls or in the roof, or burners may be present at bottom and sidewalls, at bottom and roof, at sidewalls and roof or burners may be present at the sidewalls at the bottom and at the roof.

In a preferred furnace, at least a number of the burners are positioned at the floor and/or on the roof.

The cracking coils may suitably be arranged in a staggered or extended staggered arrangement such that a high degree of symmetry in the coil layout is obtained.

Besides improved shielding and/or improved thermal stability, it is possible to realise more cracking capacity per firebox volume, due to the allowance to reduce space between the tubes, and the three or more lane configuration. It is envisaged that in particular a 10 to 20% capacity increase can be obtained in the same firebox volume compared to a conventional designed furnace.

Further, it has been found that a furnace according the invention, shows good mechanical stability also when exposed to large temperature variations. As a result, much simpler and less operator sensitive tube supports are required, to secure the tubes to a firebox wall.

In particular, a furnace wherein the inlet sections are essentially positioned symmetrically relative to the corresponding outlet sections, may be provided with cracking coils that need not be supported with guiding aids at the bottom (when the inlets/outlets are at or near the roof of the firebox) respectively at the top (when the inlets/outlets are at or near the bottom of the firebox). Thus, the coils in the firebox may very suitably be free-hanging respectively free-standing.

For good mechanical symmetry (and thereby improved thermal stability), the firebox preferably comprises cracking coils that are so called split coils, i.e. cracking coils comprising several inlet sections per outlet section, wherein the inlet sections are positioned (approximately) symmetrically relatively to the outlet sections.

Such split coils are preferably selected from coils comprising an even number of sections per outlet section, wherein one part (preferably half) of the outlet sections form the first lane of outlet sections and another part (preferably the other half) of the outlet sections form the second lane of outlet sections, the lanes being on opposite sides of the lane of inlet sections.

Preferred examples of split coils are cracking coils comprising 2 inlet sections and 1 outlet sections (2-1 arrangement, (such as more or less m-shaped/w-shaped coil), and cracking coils comprising 4 inlet sections and 1 outlet section (4-1 arrangement).

In the split-coil design applying the invention, bending of the coils, caused by the difference in expansion and creep between inlet section(s) and outlet section(s) is reduced, partly because of the shielding effect as described before, partly because of the stiffness of the mechanical design which is caused by the coil whereby for each individual coil the inlet ends are located in the two outer lanes and the outlet section of that coil is located in the inner lane which results in a highly symmetrical coil design. Such system can therefore be operated very well without a guiding system for the cracking coils, which are normally used in the art to guide the cracking coil to the floor (in case inlet/outlet are at or near the roof) or the roof (in case inlet/outlet are at or near the floor).

The split-coil is preferably designed such that at least two inlet sections are provided essentially evenly on opposite sides of each outlet section, thereby realising an essentially symmetrical coil design (such as shown in any of the FIGS. 8A and 8B, which will be discussed in detail, below)

The invention is highly suitable for use in the cracking of a hydrocarbon feed in the presence of steam, i.e. steam cracking.

A method according to the invention may very suitably be carried out, by mixing the hydrocarbon feed with steam and leading it through the tubes in the above mentioned furnace.

It has been found that in accordance with the invention, hydrocarbon feeds can be cracked very well, if desired at a higher heat density than in a known furnace. In particular, the invention is very advantageously employed in the production of ethylene, with propylene, butadiene and/or aromatics as possible co-products.

The hydrocarbon feed to be cracked may be any gaseous, vaporous, liquid hydrocarbon feed or a combination thereof. Examples of suitable feeds include ethane, propane, butanes, naphthas, kerosenes, atmospheric gasoils, vacuum gasoils, heavy distillates, hydrogenated gasoils, gas condensates and mixtures of any of these. The invention is in particular suitable to crack a gas selected from ethane, propane and mixtures of gaseous hydrocarbons. The invention is also very suitable to crack vaporized heavier feeds such as LPG, naphta and gasoil.

It has further been found that a furnace may be operated according to the invention at a much higher heat density relative to a furnace for steam cracking, known in the art. This is particularly advantageous for the capital costs employed as for the same capacity, firebox dimensions can be reduced, or alternatively for the same dimensions, much higher ethylene production (or another product) can be obtained, thereby reducing the number of furnaces required to feed a worldscale steamcracker plant. For example, it is envisaged that in a worldscale steamcracker plant based on naphtha feedstock with an annual ethylene capacity of 1.4 Million Metric Tons, the number of furnaces using conventional art (such as GK6) would be at least 9 (8 in operation, one spare). It is envisaged that 7 furnaces according to the invention suffice for the same annual ethylene capacity (6 in operation, one spare). It has been found that a furnace according to the invention can be operated with a relatively low temperature difference across the outlet section and thus has a relatively high degree of isothermicity. In a conventional process in a conventional furnace, the temperature rise of the gas across the last tube of the outlet section of the coil in a cracking process is typically about 60-90° C., whereas in a similar process carried out in a furnace according to the invention the temperature rise is usually less, typically about 50-80° C. Thus the invention allows a reduction of about 10° C. in temperature rise, which is energetically advantageous.

Thus, the average process temperature can be relatively high, allowing for a relatively short residence time, to yield a specific feed conversion, in comparison to a comparable furnace without shielded outlet section. For instance, the residence time for a GK6™ furnace is typically 0.20-0.25 sec, whereas in a comparable process employed in a furnace of the present invention the residence time may be reduced to about 0.17-0.22 sec. Thus the present invention allows for a reduction in residence time of about 15%, to achieve a particular conversion, compared to a GK6™ furnace.

It has also been found that in a furnace according to the invention, respectively with a method according to the invention, a very good reaction selectivity is feasible, showing a relatively low tendency to form undesired by-products.

Figure 1:
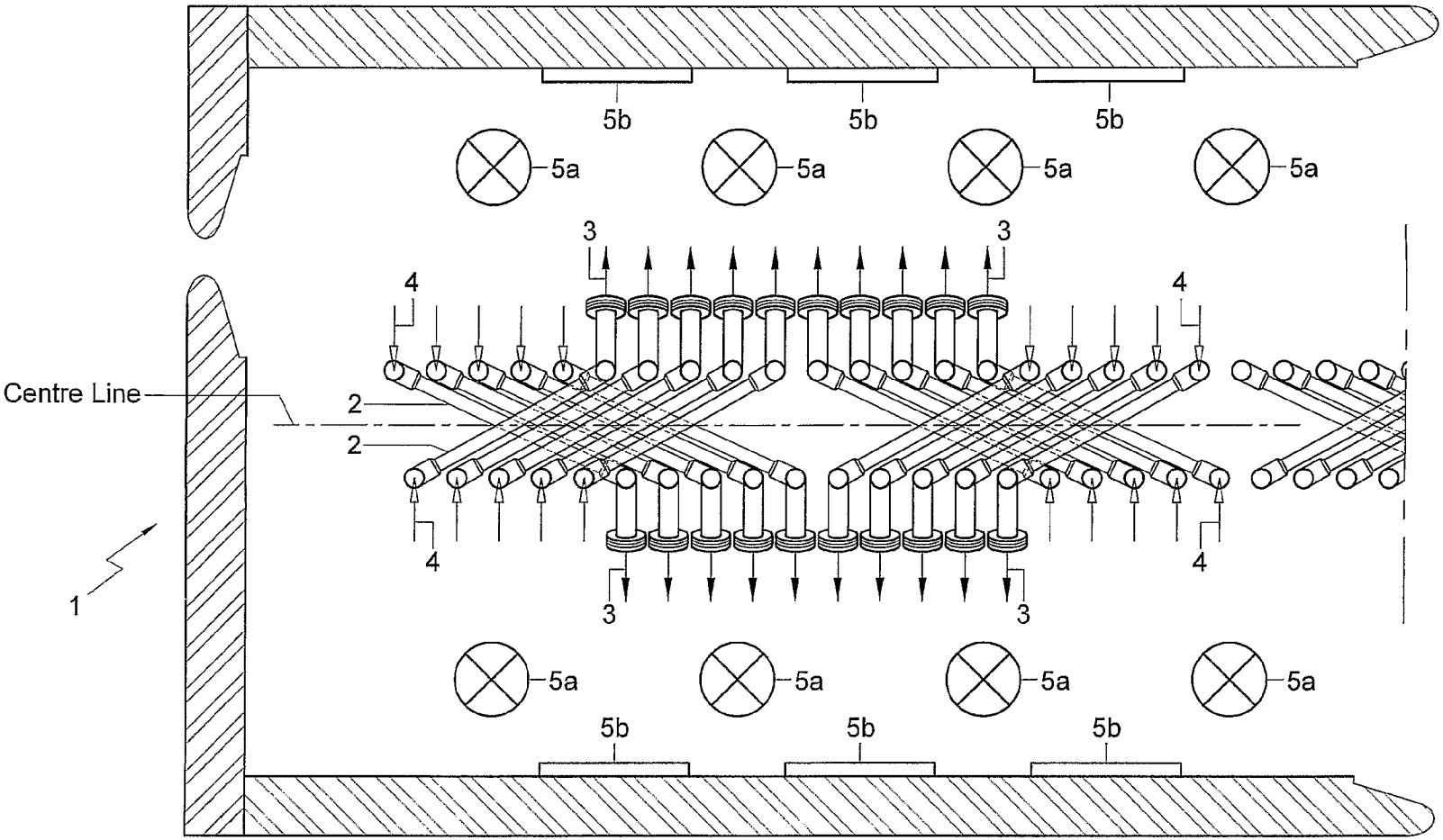
FIG. 1 schematically shows a conventional cracking furnace (GK6™).
Figure 2A:
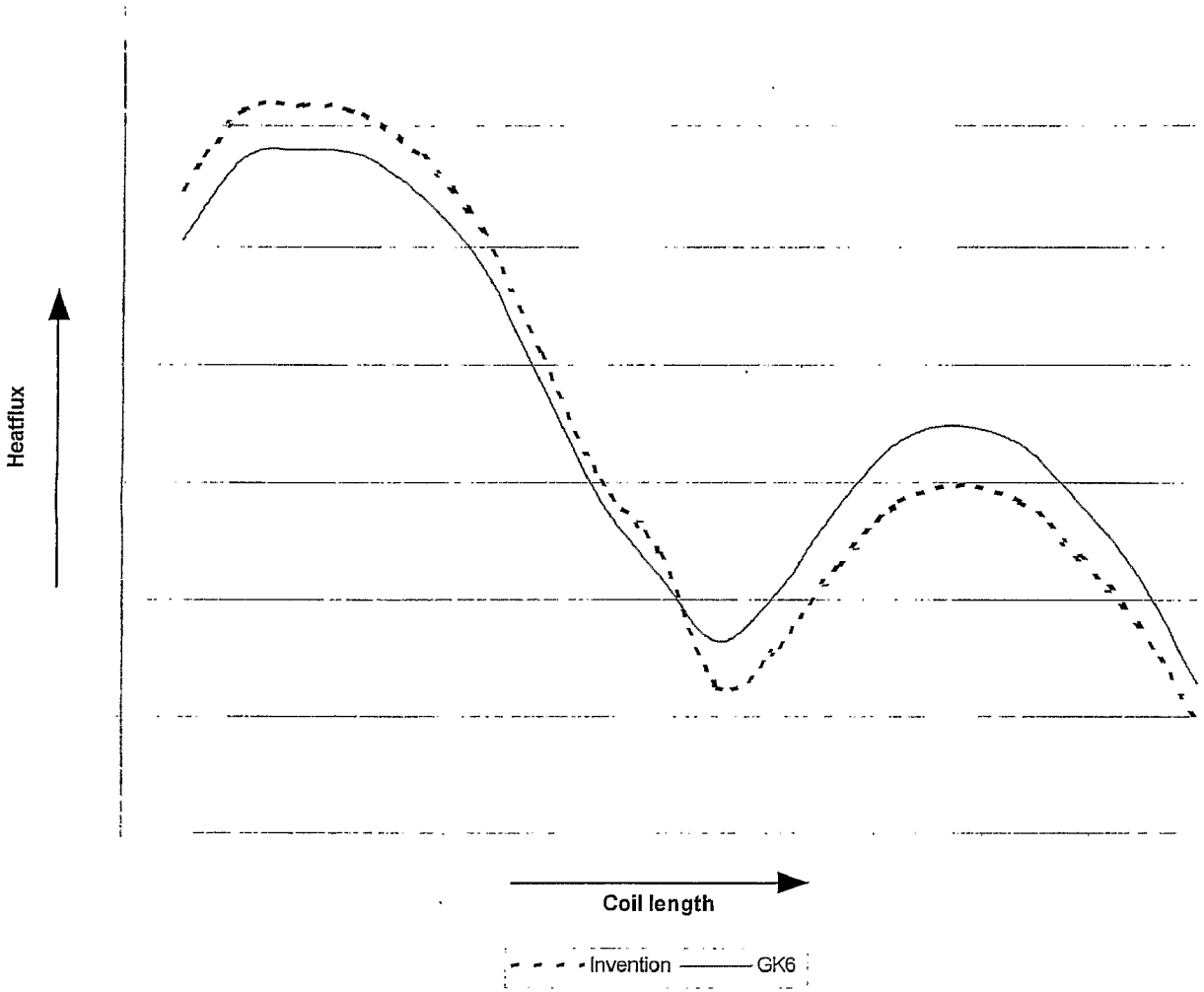
FIG. 2A shows a typical heat flux profile of a GK6™ furnace and a profile under similar circumstances for a furnace according to the invention (simulated by SPYRO®).

A typical heat flux profile of a GK6™ furnace and a profile under similar circumstances for a furnace according to the invention are shown in FIG. 2A (simulated by SPYRO®, a simulation tool much used in the ethylene industry for simulating cracking furnaces). In accordance with the invention, it has been calculated that the coil capacity increase in this example (compared to GK6™) is about 10-15% in throughput, 40% in run length and/or 1-3% in olefin selectivity when cracking full range naphtha at the same cracking severity or conversion.

Further, it has been found that a furnace according to the invention can be operated with a low tendency of cokes formation inside the cracking coil, in comparison to some known furnaces, especially at the outlet end of the cracking coil. Thus, the invention allows for a high availability of the furnace, as intervals between subsequent maintenance sessions to remove cokes can be increased.

In a furnace according to the invention, the outlet sections of the coils are advantageously positioned in the firebox in at least one lane, which at least one lane is in between a first lane of burners and a second lane of burners. For practical reasons, the lanes are preferably essentially parallel.

As indicated above, very suitable is a furnace wherein the inlet sections of the coils act as a thermal shield and/or mechanical stabiliser for the outlet sections, such as in a cracking furnace wherein the inlet sections are positioned in between the outlet sections and the burners. This configuration has been found very efficient, with respect to the heat distribution, the symmetry and/or achieving a desirable thermal profile throughout the length of the coils.

Accordingly, in a very advantageous embodiment, the present invention relates to a cracking furnace comprising a firebox, wherein at least one lane of outlet sections of the coils, at least two lanes of inlet sections of the coils and at least two lanes of burners are present, in which firebox the at least one lane (O) of outlet sections is located between the at least two lanes (I) of inlet sections and the lanes of inlet sections are located (which inlet sections act as a thermal shield during cracking) in between the at least one lane of outlet sections and the at least two lanes of burners (B). Thus viewing from the top or bottom of the firebox, this configuration can be represented as a B-I-O-I-B configuration.

Examples of highly suitable embodiments are shown in FIGS. 3, 4, 5, 6, 7 and 8. These examples all show a configuration with inlet and outlet of the coils at or near the roof and burners being disposed at the opposite of the inlet/outlet ends of the tubes, at the floor and/or the sidewalls. It should be noted that it is also possible to operate a furnace that is rotated relative to the shown configuration, in particular a furnace wherein the inlet/outlet ends of the tubes are at or near the bottom of the furnace. In that case the floor burners are preferably replaced by burners positioned at or near the roof.

The arrangement of outlet sections and inlet sections can advantageously be configured in a herringbone-like arrangement. With such an embodiment a very effective shielding and mechanical symmetry has been found feasible.

Figure 3A:
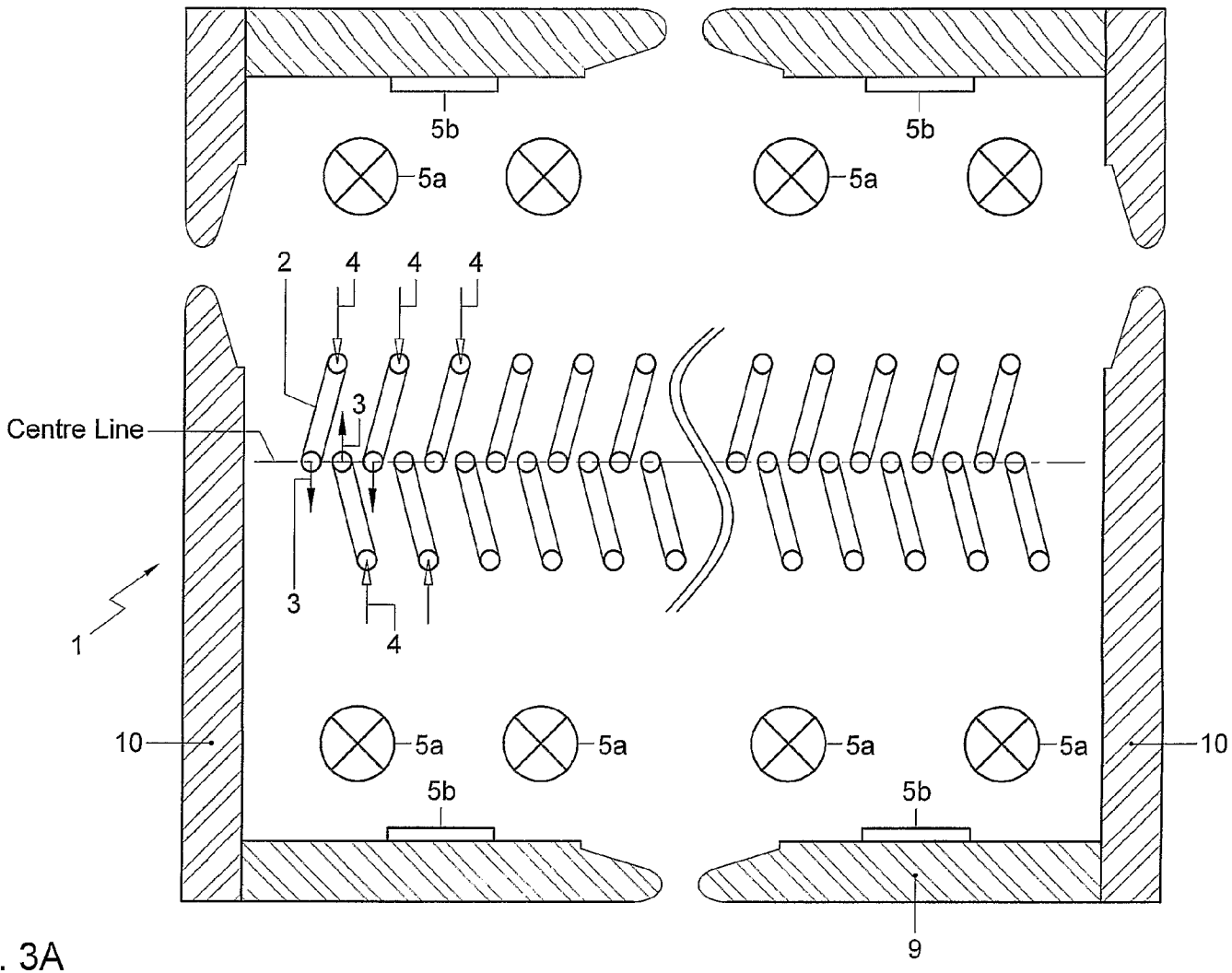
FIG. 3A shows a top view intersection of a cracking furnace according to the invention with a herringbone-like set up.
Figure 3B:
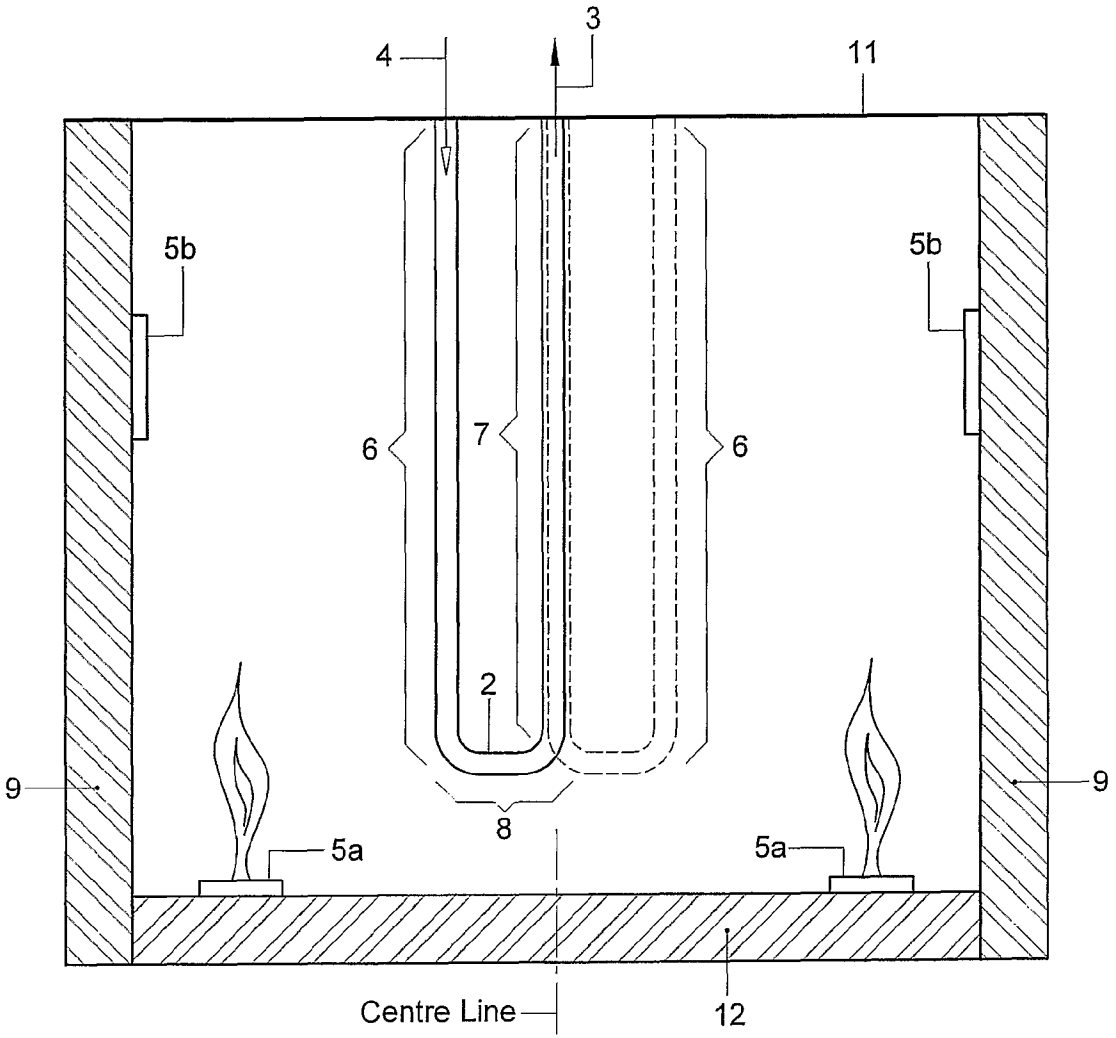
FIG. 3B shows a front view intersection of the furnace of FIG. 3B.

FIG. 3 shows a cracking furnace with a herringbone-like set up. In this figure, the cracking coils each comprise one inlet (4, FIG. 3A) and one outlet (3, FIG. 3A). The cracking coils are configured essentially vertically in a three lane assembly. The individual inlet/outlet sections are arranged in a isosceles triangular pitch viz a viz each other. Alternatively the individual inlet/outlet sections maybe arranged in a equilateral triangular pitch, or alternatively in a right-angled triangular pitch (FIG. 4) or alternatively any form of a scalene or non-scalene triangular pitch. In FIG. 3, burners 5 are shown at the floor (floor burners 5*a*) and the side walls (side wall burners 5*b*), although burners may be placed only at the floor 12 or only at the side walls 9. In general, if side burners are present in a furnace of the invention, these are preferably positioned in the top half of the side walls in case the inlet and outlet are at or near the roof, and positions in the bottom half of the side walls in case the inelt and outlet are at or near the floor.

In FIG. 3 (wherein FIG. 3A shows a top view intersection and FIG. 3B a front view intersection), cracking coil 2 have their inlet 4 and outlet 3 at or near the roof 11 of the firebox 1. The coil inlet sections (6, FIG. 3B) typically start at the inlet and extend in this embodiment until the part of the coil where the inlet section is connected to a return bend (8, FIG. 3B) out of the plane formed by the inlet sections, away from the burners towards the centre-line of the furnace. The outlet sections (7, FIG. 3B) typically start at the end of the return bend (8, FIG. 3B)). In principle, the outlet section can extend to the position where the inlet section ends. More in particular the outlet section is considered the part of the coil between the outlet and the part of the coil where the coil bends out of the plane formed by the outlet end of the coil.

A better mechanical stability is obtained due to the fact that in a (geometrically) parallel lane arrangement of three or more lanes formed by the cracking coil sections, the inlet sections and outlet sections are more isothermal than with a one or dual lane arrangement.

Figure 4:
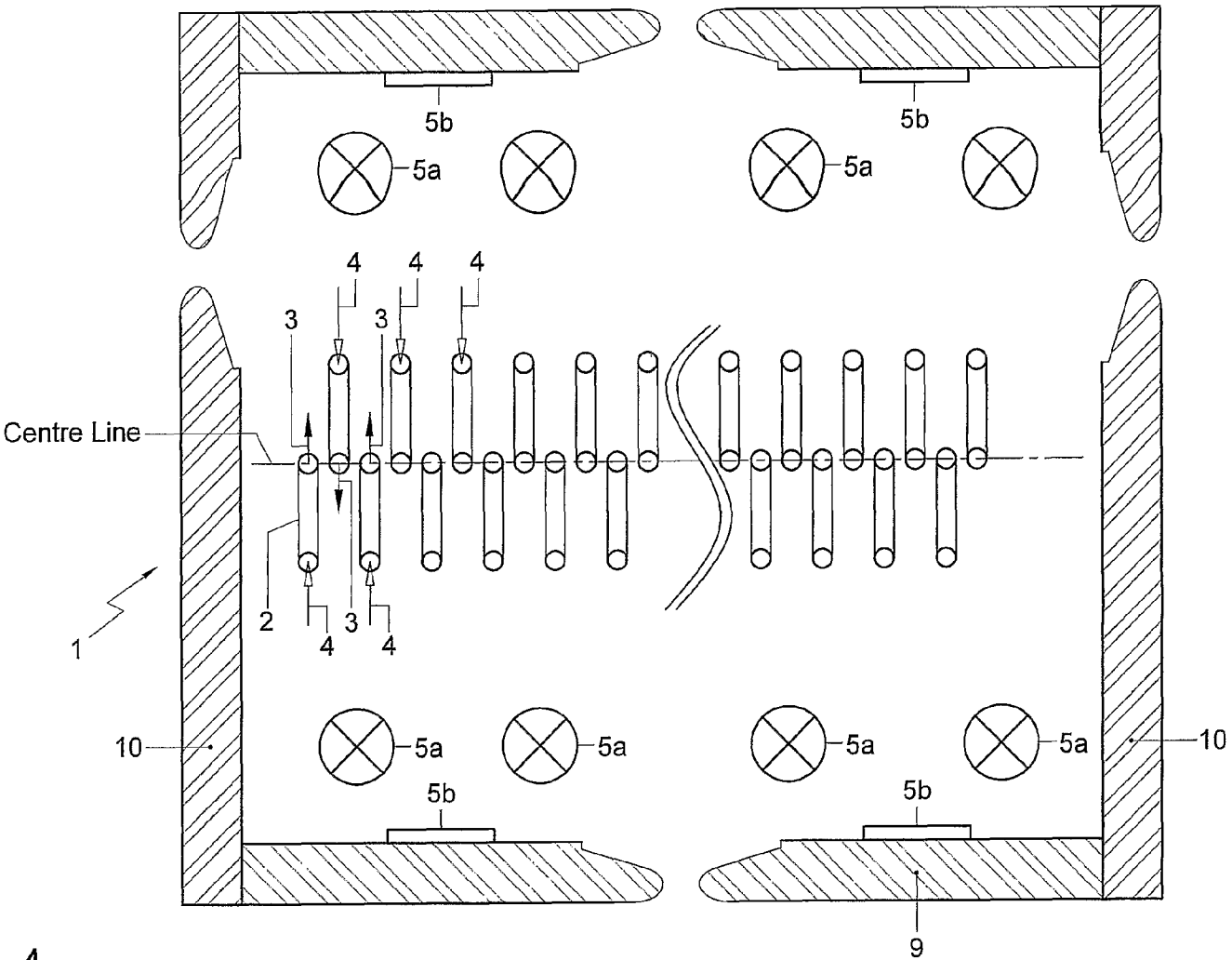
FIG. 4 shows an alternative arrangement of the same coil type and coil assembly as FIG. 3 but with a right-angled triangular pitch between the individual coil sections.

FIG. 4 shows an alternative arrangement of the same coil type and coil assembly as FIG. 3 but with a right-angled triangular pitch between the individual coil sections. The main distinction with FIG. 3 is the arrangement of the coils, each coil now being essentially perpendicular to the lines with burners.

FIG. 5 shows yet another highly advantageous design, the main difference compared to FIGS. 3 and 4 being the design of the coils, which now is a two-pass split coil lay out. The coils have two inlets 4 (split flow) and one outlet 3. FIG. 5A shows a top view of such furnace. FIG. 5B shows a 3-D view of a single coil in such a furnace. FIG. 5C and 5D show respectively a side view and a front view of a single coil. In front view (FIG. 5D), the appearance of the tube (coil) is more or less m-like or w-like. In case of an m-like shape, the burners are preferably placed at the (lower half of the) sides and/or the roof, instead of at the floor.

Figure 6A:
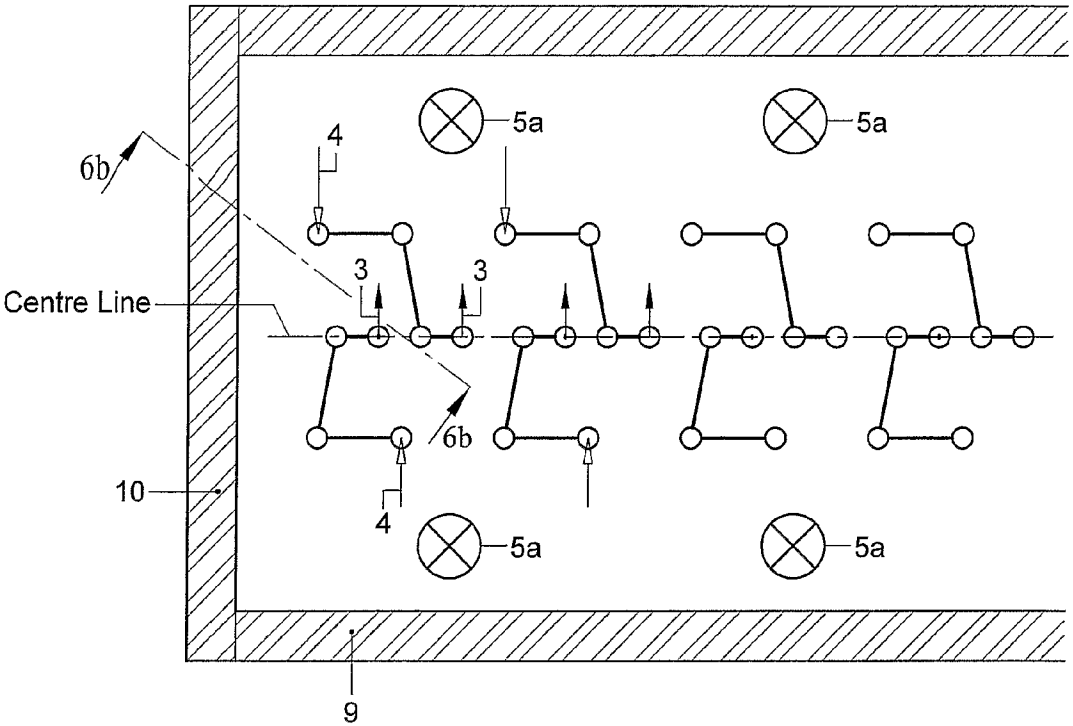
FIG. 6A shows a furnace with a 4-pass coil.
Figure 6B:
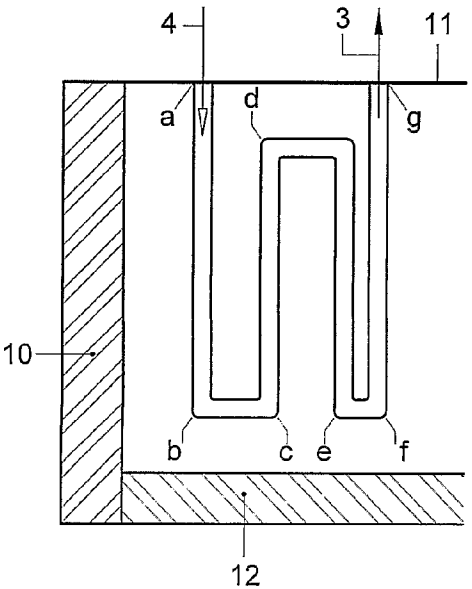
FIG. 6B shows a coil as in the furnace of FIG. 6A.

FIG. 6 shows a furnace with a 4-pass coil. Herein the better thermal stability is obtained by a higher level of isothermicity and shielding is in particular effected by the part of the coil from a to d and the shielded section in particular comprises the part of the coil from d to g. A furnace with a 4-pass coil, e.g. as shown in FIG. 6, has been found particularly suitable for cracking a feedstock requiring a relatively long residence time for realising a particular conversion, for instance for the cracking of ethane.

Figure 8A:
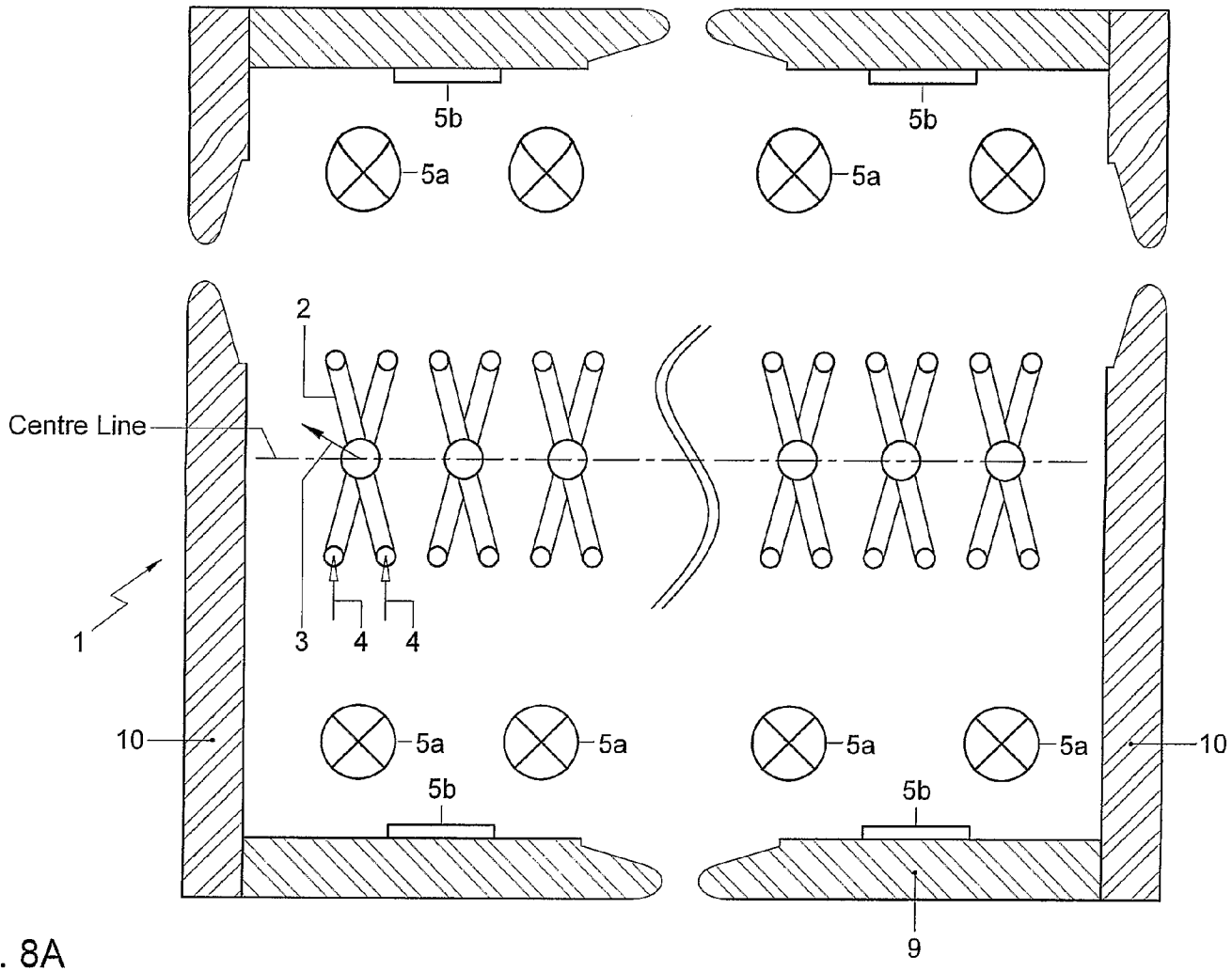
FIG. 8A shows a furnace according to the invention with a highly symmetrical 4-1 coil layout in a three lane in top view intersection.
Figure 8B:
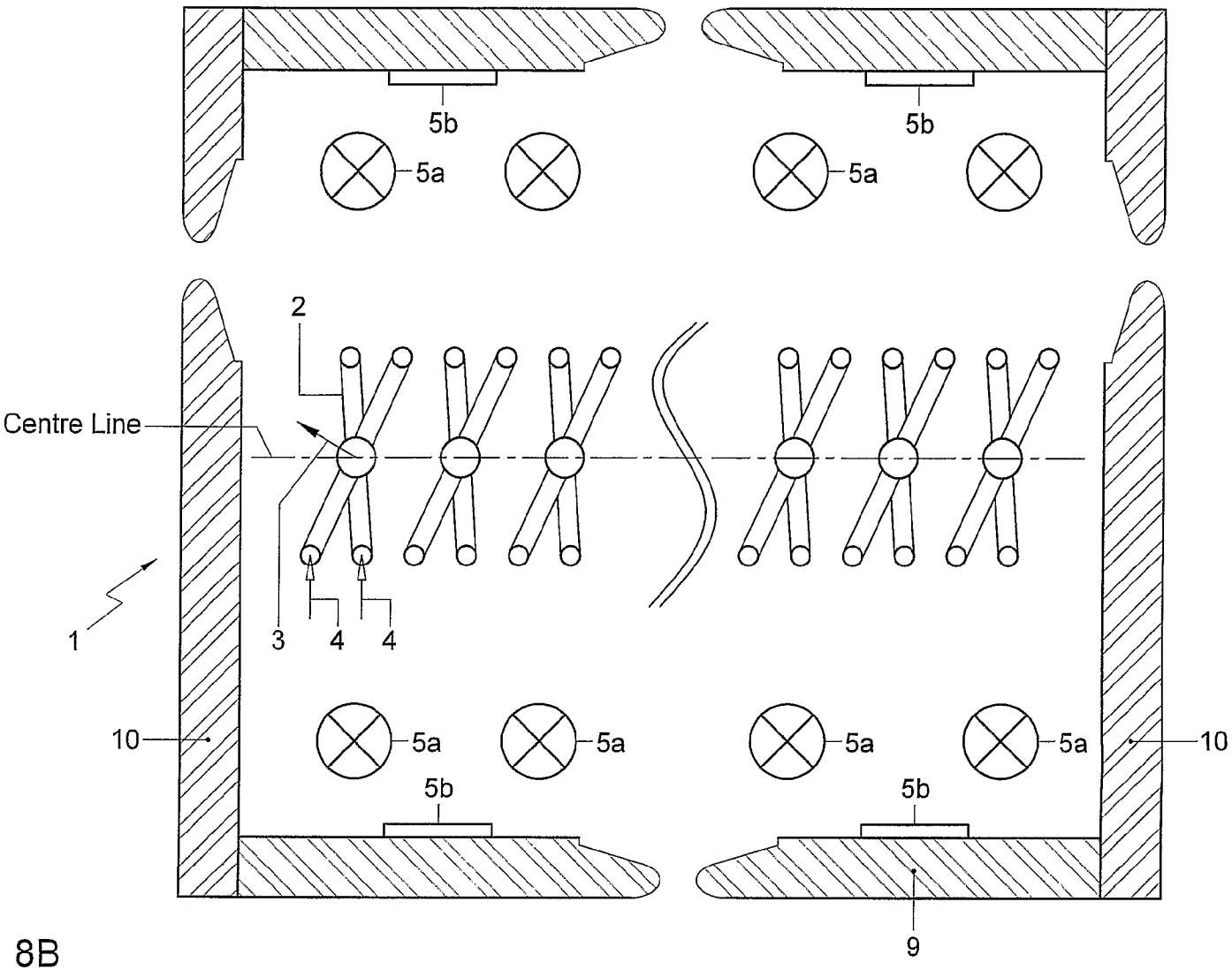
FIG. 8B shows another furnace with a symmetrical 4-1 coil lay out (top view intersection).
Figure 8C:
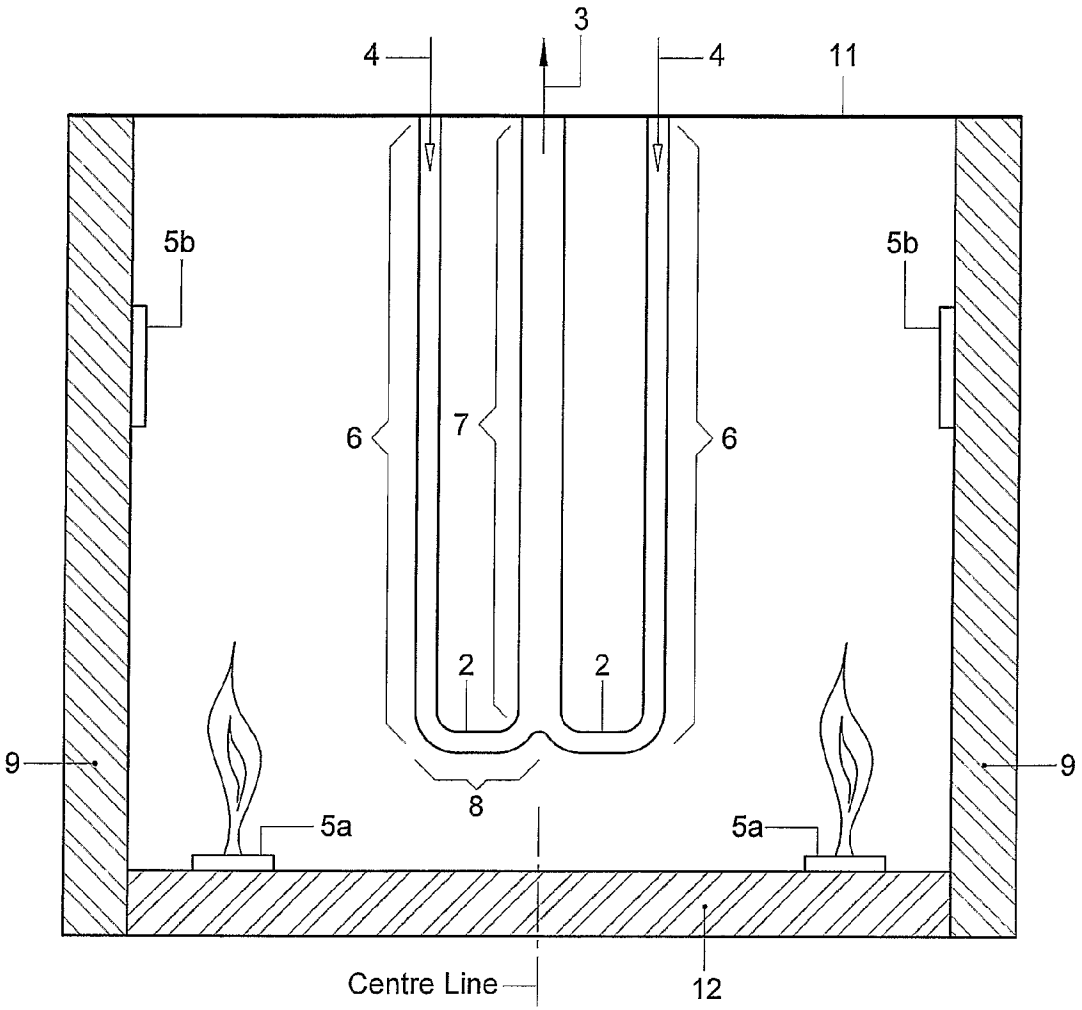
FIG. 8C shows a front view intersection of a furnace according to FIG. 8A and 8B.

Two examples of a highly symmetrical 4-1 coil layout in a three lane arrangement applying the invention are shown in FIG. 8 (wherein FIGS. 8A and 8B show a top view intersection of two embodiments and FIG. 8C shows a front view intersection, which is applicable to both the embodiments of FIG. 8A and FIG. 8B). In FIG. 8A, the individual sections of the coils are positioned in a isosceles triangle viz a viz each other whereby the inlet sections are positioned not only symmetrical relative to the outlet section but also relative to the centre line (through the lane of outlet sections). FIG. 8B gives the same 4-1 coil arrangement but with a scalene triangular pitch between the individual tubes.

In FIG. 8, cracking coil 2 has four inlets 4 and one outlet 3 (at or near the roof 11 of the firebox 1). The inlet sections of each coil typically start at the inlet and extend in this embodiment until the part of the coil where the coil is connected to a return bend which bends out of the plane formed by the inlet tubes, away from the burners towards the centre line of the furnace.

The outlet sections (7, see FIG. 8C) typically start at the end of the return bend 8.

In principle, the outlet section can extend to the position where the inlet section ends. More in particular the outlet section is considered the part of the coil between the outlet of the coil and the end of the return bend.

The section between outlet section and inlet section is then referred to as the return bend 8.

In FIG. 8C the inlet section 6 are positioned between burners 5 and outlet sections 7, thereby partly thermally shielding the outlet sections 7.

A (mainly) symmetrical distribution of inlet sections on opposite sides of the outlet sections has been found beneficial with respect to resistance against detrimental deformation of the tubes as a result of thermal stress and may extent life time of the coils.

As a result, the cracking coils may be present in the firebox without being supported (guided) to the bottom (in case the inlet and outlet are not provided in the bottom, but leave the firebox through the roof or near the roof), respectively to the roof (in case inlet and outlet are present in the bottom or near the bottom). Thus, the coils may hang freely respectively stand freely in the fire box, without being fastened by a bottom guide respectively a roof guide.

The skilled person will know how to build an apparatus with suitable dimensions, based upon the teaching herein and common general knowledge.

In principle, the design of an apparatus of the present invention can be based upon criteria commonly used when designing a cracking furnace. Examples of such criteria are distances between coils, between burners and between burners and coils, coil inlets/outlets, outlet for flue gases, design of the fire-box, burners and other parts.

Burners that fire gaseous fuel are particularly suitable.

The burners may be positioned at any place inside the firebox, in along the floor and/or side walls Very good results have been achieved with such a cracking furnace wherein the burners are positioned at the floor of the firebox and the coil outlet section(s) extend(s) through the roof of the firebox or at least through a side wall, close to the roof. Optionally, additional burners are present at the sidewalls, preferably at least in the top half.

It has further been found advantageous that burners are present at (radially) each opposite side of the two outer lanes containing the outlet sections of the coils present in the firebox.

This leads to a more isothermal temperature distribution over the length of each coil.

For a symmetrical firing pattern over the width of the firebox, it is further preferred in a furnace according to the invention, that each opposite lane of burners during cracking, generate about the same amount of heat. Analogously in a method of the invention it is preferred that during cracking, each opposite lane or opposite set of lanes of burners have same or similar mechanical and process design characteristics.

As cracking coils (cracking tubes), those known in the art can be used. A suitable inner diameter is for example chosen in the range of 25-120 mm, depending upon the feedstock quality and the number of passes per coil. The cracking coils are preferably disposed essentially vertically in the firebox (i.e. preferably the coils are disposed such that a plane through the tube is essentially perpendicular to the floor of the firebox). The coils may be provided with features such as but not limited to extended internal surface, that enhance the internal heat-transfer coefficient. Examples of such features are known in the art and commercially available.

The inlets for the feed into the coils preferably comprise a distribution header and/or a critical flow venturi'a. Suitable examples thereof and suitable ways to employ them are known in the art.

Figure 7:
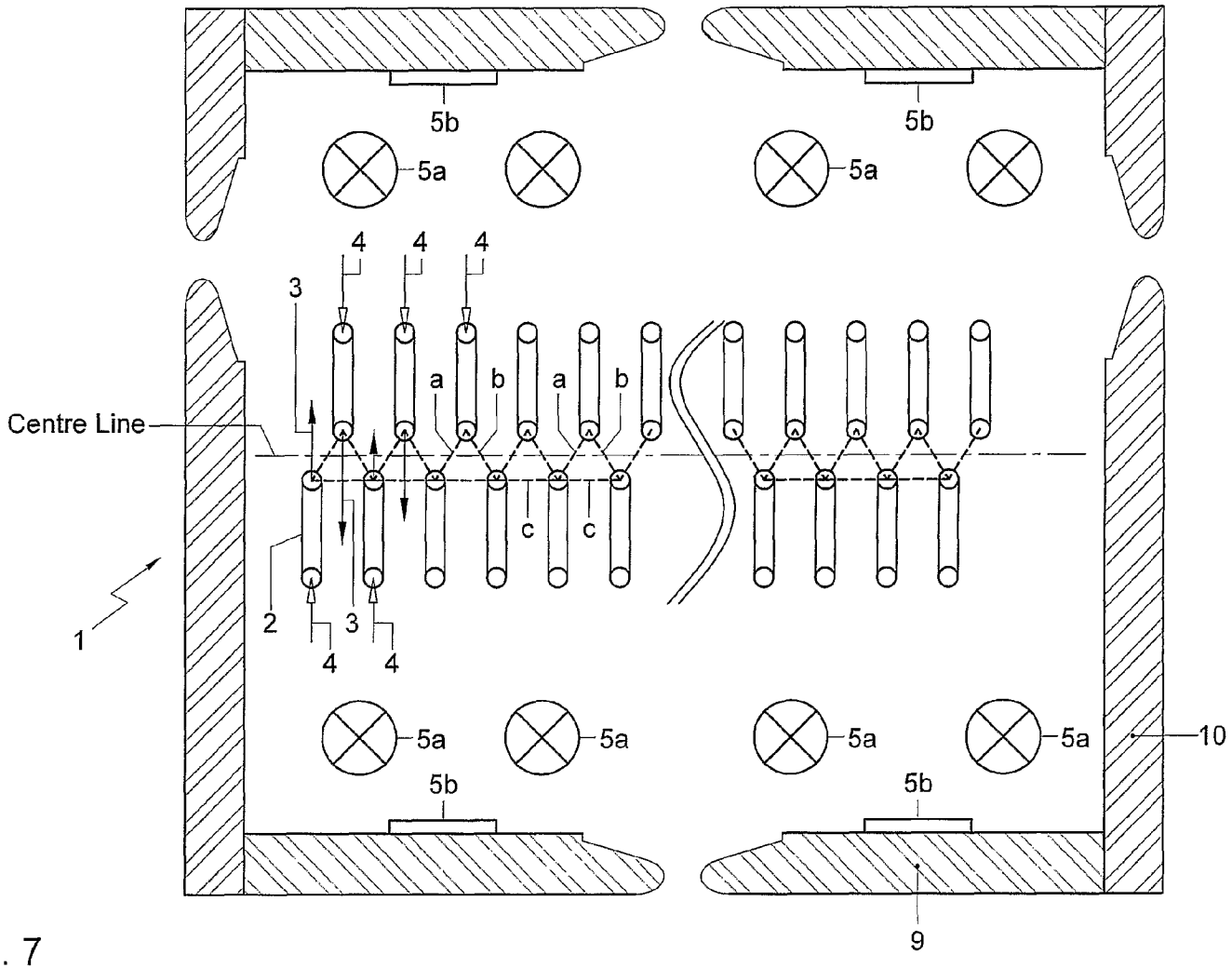
FIG. 7 shows a furnace according to the invention wherein the outlet sections are in a staggered configuration.

The outlet sections may suitably be arranged in an in-line configuration (see e.g. FIGS. 3, 4, 5 and 6), wherein the outlets are along a single line along the box (typically along or parallel to the centre line of the box) or a staggered configuration (e.g. FIG. 7). The staggered configuration may be a fully staggered configuration (i.e. wherein three subsequent outlet sections are disposed in a triangular pattern with equal sides (length of a, b and c identical; see e.g. FIG. 7), also known as equilateral triangular pitch or an extended staggered configuration (i.e. wherein the outlet sections are disposed in a isosceles triangular pitch formed by the sides a, b and c (as indicated in FIG. 7) wherein side c is different from the sides a and b and wherein sides a and b are equal, or an scalene triangular pattern formed by sides a,b,c (as indicated in FIG. 7) wherein each of the sides a,b,c (as indicated in FIG. 7) of the extended triangle differ in length from the other sides.

For a very effective shielding of the outlet sections, an in-line configuration has been found very suitable.

In a cracking furnace according to the invention, the pitch/outside diameter ratio is preferably selected in the range of 1.5 to 10 more preferably in the range of 2 to 6. In this context pitch is the distance between the centre lines of two adjacent tubes in the same plane ("c" in FIG. 7).

A cracking process according to the invention is usually carried out in the absence of catalysts. Accordingly, in general the cracking tubes in a furnace according to the invention are free of a catalytic material (such as a catalytic bed).

The operating pressure in the cracking coil is in general relatively low, in particular less than 10 bara, preferably less than 3 bara. The pressure at the outlet is preferably in the range of 1.1-3 bara, more preferably in the range of 1.5-2.5 bara. The pressure at the inlet is higher than at the outlet and determined by pressure difference The pressure difference between inlet and outlet of the cracking tube(s) is 0.1 to 5 bar, preferably 0.5-1.5 bar.

The hydrocarbon feed is usually mixed with steam. The weight to weight ratio of steam to hydrocarbon feed may be chosen within wide limits, depending upon the used feed. In practice, the ratio is usually at least about 0.2, in particular between about 0.2 and about 1.5. For the cracking of ethane a value of less than about 0.5 is preferred (in particular of about 0.4). For heavier hydrocarbon feeds, normally a higher ratio is employed. Preferred are in particular: a ratio of about 0.6 for naphta's, a ratio of about 0.8 for AGO (atmospheric gas oil) and for HVGO (hydrotreated vacuum gas oil) and a ratio of about 1 for VGO (vacuum gas oil).

Hydrocarbon feed, typically mixed with dilution steam, is preferably fed to the coil(s), after being heated to a temperature of more than 500° C., more preferably to a temperature of 580-700° C. even more preferably a temperature in the range of 590-680° C. In case a (at least partially) liquid feed is used, this preheating generally results in vaporisation of the liquid phase.

In the cracking coil(s), feed is preferably heated such that the temperature at the outlet is up to 950° C., more preferably to an outlet temperature in the range of 800-900° C. In the cracking tubes hydrocarbon is cracked to produce a gas which is enriched in unsaturated compounds, such as ethylene, propylene, other olefinic compounds and/or aromatic compounds. The cracked product leaves the firebox via the outlets and is then led to the heat-exchanger(s), wherein it is cooled, e.g. to a temperature of less than 600° C., typically in the range of 450-550° C. As a side-product of the cooling steam may be generated under natural circulation with a steam drum.

EXAMPLES

Figure 2B:
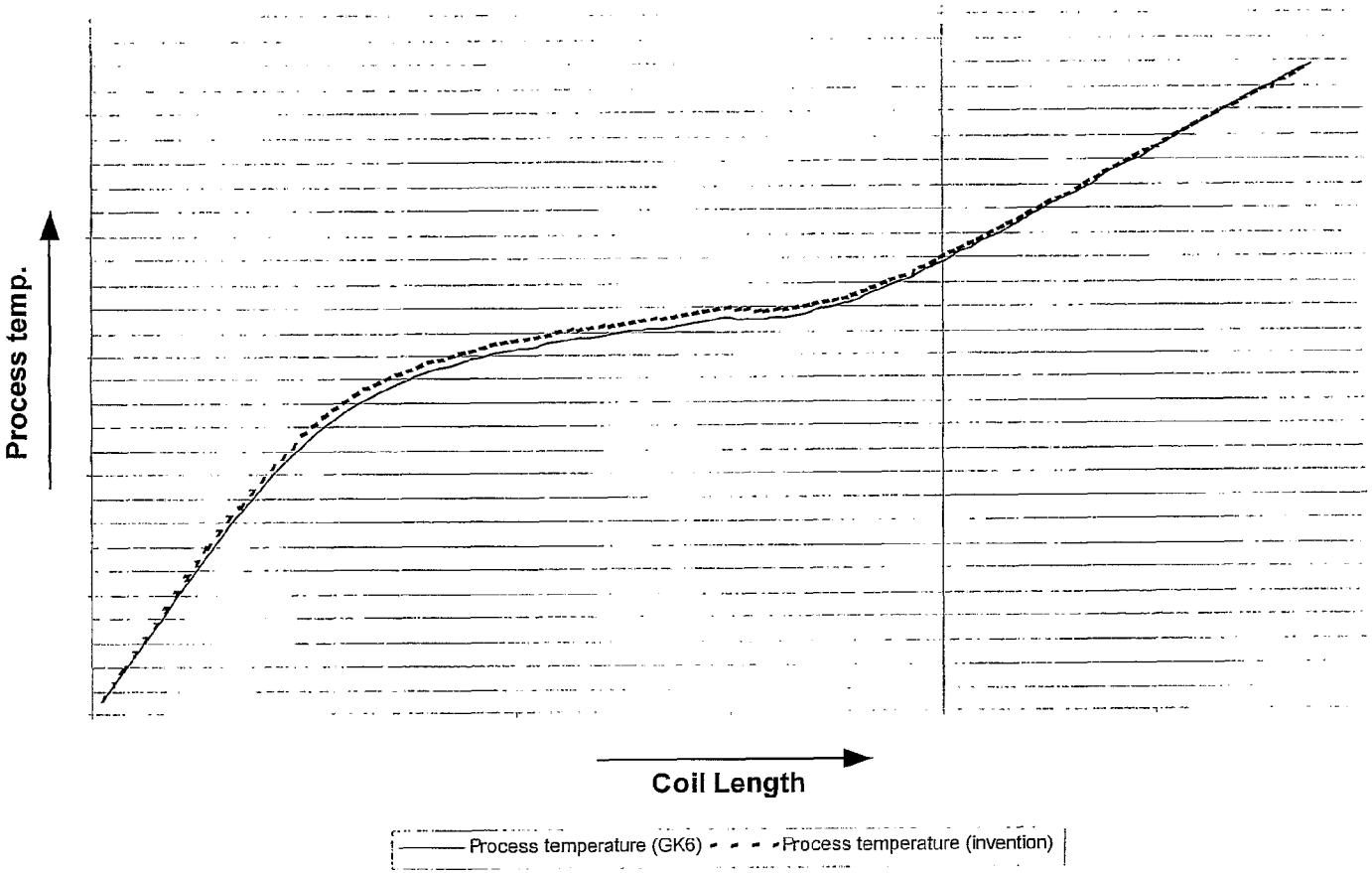
FIG. 2B shows the process temperature along the coil of a GK6™ furnace and a profile under similar circumstances for a furnace according to the invention (simulated by SPYRO®).
Figure 2C:
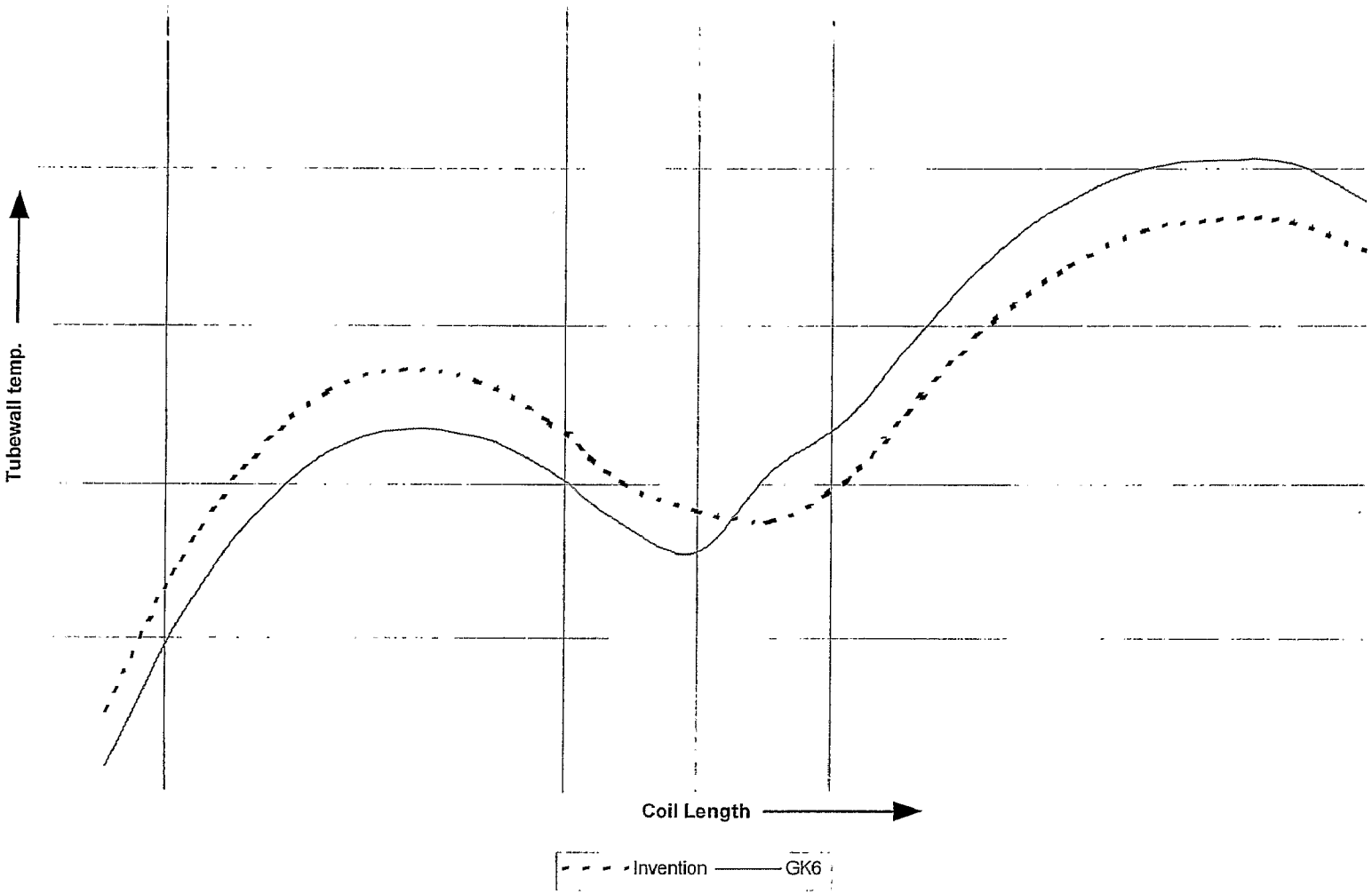
FIG. 2C shows the coil wall temperature along the coil length.

A cracking process was simulated for a furnace according to the invention and a GK6 furnace using SPYRO® (See Table 1 for conditions). FIGS. 2A-2C show the heat flux profiles, the process temperature along the coil and the tube wall along the coil.

Applying the invention wherein coil dimensions of the furnace according to the invention are the same as those of the GK6 furnace and whereby all process parameters such as flow rate, cracking severity, etc are kept the same, run length (max. operation time without needing shutting down the installation for maintenance) is extended from 60 to 80 days. Results are tabulated in column "Equal". Keeping same coil dimensions and applying the invention whereby all process parameters except capacity are kept the same and whereby capacity is increased to maintain same run length as with GK6, results in an increase of capacity from 40 to 45 metric/tons, thus 12.5% more ethylene production than with GK6. Results are tabulated in column "Capacity". Applying the invention to furnace containing coils that are designed such as to process the same amount of feed, operating at the same severity and designing for same run length at that operation, all compared with GK6, results in an increase of ethylene yield from 27.7 to 28.1 wt % on hydrocarbon feed, thus saving 1.4% of feedstock for same amount of main products ethylene and propylene.

TABLE 1

| | | | Invention | | |
|---|---|---|---|---|---|
| | | GK-6 | Equal | Capacity | Selectivity |
| Total flow | t/h | 40 | 40 | 45 | 40 |
| Twall at end-of-run | ° C. | 1100 | 1100 | 1100 | 1100 |
| End-of-run | days | 60 | 80 | 60 | 60 |
| CH4 yield | wt. % dry | 15.7 | 15.7 | 15.7 | 15.6 |
| C2H4 yield | wt. % dry | 27.7 | 27.7 | 27.7 | 28.1 |
| C3H6 yield | wt. % dry | 14.1 | 14.1 | 14.1 | 14.3 |
| Relative runlength | % | 100% | +13% | 100% | 100% |
| Relative capacity | % | 100% | 100% | +13% | 100% |
| Relative selectivity | % | 100% | 100% | 100% | +1.4% |

The invention claimed is:

1. A method for cracking a hydrocarbon feed comprising a hydrocarbon and a diluent gas, the method comprising:

passing the feed through a cracking coil in a firebox under cracking conditions, wherein the coil comprises at least one outlet section and at least one inlet section, and wherein the outlet section of said coil is more thermally shielded than the inlet section of said coil.

2. The method according to claim 1, wherein the firebox comprises at least one lane of outlet sections of the coils, at least two lanes of inlet sections of the coils and at least two lanes of burners, and wherein the at least one lane of outlet sections is located between at the least two lanes of inlet sections and the lanes of inlet sections are located in between the at least two lanes of burners.

3. The method according to claim 2, wherein the coils are arranged about vertical and about parallel to each other.

4. The method according to claim 1, wherein the coils are arranged about vertical and about parallel to each other.

5. The method according to claim 1, wherein the feed is passed through the coils in a parallel flow in at least part of the coils.

6. The method according to claim 1, wherein the hydrocarbon feed including diluent gas is heated to a temperature above the vaporisation temperature in the cracking coil or prior to the passing into the cracking coil.

7. The method according to claim 1, wherein the feed comprises a hydrocarbon selected from the group consisting of ethane, propane, butanes, naphthas, kerosenes, atmospheric gasoils, vacuum gasoils, heavy distillates, hydrogenated gasoils, gas condensates and mixtures thereof.

8. The method according to claim 1, wherein at least one product formed comprises a substance selected from the group consisting of ethylene, propylene and butadiene.

9. The method for cracking a hydrocarbon according to claim 1, wherein the said firebox is comprised in a cracking furnace.

10. The method according to claim 1, wherein the diluent gas comprises steam.

11. A cracking furnace for steam cracking a hydrocarbon feed, the furnace comprising a firebox comprising:

a plurality of cracking coils comprising inlet sections and outlet sections, with outlet sections of the coils positioned in at least one lane and with inlet sections of the coils positioned in at least two lanes; and at least two lanes of burners, wherein the at least one lane of outlet sections is located between at the least two lanes of inlet sections and the at least two lanes of inlet sections are located in between the at least two lanes of burners.

12. The cracking furnace according to claim 11, wherein the lanes are about parallel to each other.

13. The cracking furnace according to claim 12, wherein the outlet sections and the inlet sections are positioned about vertically, at least during use.

14. The cracking furnace according to claim 11, wherein the outlet sections and the inlet sections are positioned about vertically during use.

15. The cracking furnace according to claim 11, wherein the inlet sections in each lane of the at least two lanes and the outlet sections in the at least one lane are arranged in an inline arrangement or in a staggered arrangement, and the inlet sections in each lane of the at least two lanes are positioned in a staggered configuration with respect to outlet sections present in an adjacent parallel lane.

16. The cracking furnace according to claim 15, wherein, the arrangement of the sections is in an equilateral triangular pitch, a isosceles triangular pitch, a right angled triangular pitch or a scalene triangular pitch.

17. The cracking furnace according to claim 16, wherein the sections are unguided to a bottom of the firebox.

18. The cracking furnace according to claim 11, wherein at least a number of the burners is positioned at the floor and/or the roof of the firebox and/or the side walls of the firebox and wherein the outlets of the coils extend through the roof of the firebox.

19. The cracking furnace according to claim 11, wherein at least a subset of coils of the plurality of cracking coils is arranged in a arrangement configured for parallel flow of the feed through each coil of the subset of coils during use.

20. The cracking furnace according to claim 11, wherein the plurality of coils consists of at least one group of the following:

coils comprising two inlet sections arranged to allow parallel flow during use and one outlet section in fluid communication with the inlet sections; and coils comprising four inlet sections arranged to allow parallel flow during use and one outlet section in fluid communication with the inlet sections.

21. The cracking furnace according to claim 11, wherein the outlet sections are arranged in an in-line configuration or a staggered configuration, and wherein the pitch/outside diameter ratio is in a range of 1.5 o 10.

22. The cracking furnace according to claim 21, wherein the pitch/outside diameter ratio is in the range of 2 to 6.

* * * * *